US005193924A

United States Patent [19]

Larson

[11] Patent Number: 5,193,924

[45] Date of Patent: Mar. 16, 1993

[54] CAP COVER FOR KEYBOARD KEYS

[76] Inventor: Carlyn F. Larson, 3021 Moore St., Boise, Id. 83702

[21] Appl. No.: 742,371

[22] Filed: Aug. 8, 1991

[51] Int. Cl.[5] ..... B41J 5/16

[52] U.S. Cl. ..... 400/472; 235/145 R

[58] Field of Search ..... 400/472, 676, 677, 693, 400/496, 714, 490, 493, 493.1, 495, 679; 341/22; 200/302.1, 333, 334, 335; 235/145 R, 146; 434/229; 150/164, 162, 154; 222/531, 476

[56] References Cited

U.S. PATENT DOCUMENTS

| | | | |
|---|---|---|---|
| 1,148,721 | 8/1915 | Scott . | |
| 2,492,262 | 12/1949 | Boyden et al. | 45/68.1 |
| 3,208,021 | 9/1965 | Elliot | 200/302.1 |
| 3,627,097 | 12/1971 | Plieninger | 197/107 |
| 3,848,723 | 11/1974 | Hogue | 197/102 |
| 3,871,506 | 3/1975 | Von Luders | 400/495 |
| 4,012,127 | 3/1977 | Bolander | 400/490 |
| 4,084,214 | 4/1978 | Eppich | 235/145 R |
| 4,257,555 | 3/1981 | Neel | 200/333 |
| 4,362,408 | 12/1982 | Cordes et al. | 400/481 |
| 4,540,858 | 10/1985 | Knoop | 200/333 |
| 4,755,072 | 7/1988 | Hoornweg | 400/490 |
| 4,948,281 | 8/1990 | Werner | 400/472 |

FOREIGN PATENT DOCUMENTS

| | | | |
|---|---|---|---|
| 0556958 | 9/1929 | Fed. Rep. of Germany | 400/493.1 |
| 2207432 | 8/1990 | Japan | 200/333 |

*Primary Examiner*—Edgar S. Burr
*Assistant Examiner*—Anthony H. Nguyen
*Attorney, Agent, or Firm*—Frank J. Dykas; Craig M. Korfanta; Ken J. Pedersen

[57] ABSTRACT

The invention is a cap cover for keyboard keys comprising a generally rectangular in the horizontal plane hollow box with a closed end and an open end, said open end being adapted to rest on a base plate or a grid plate of a keyboard, and said hollow box being adapted to receive keys or sets of keys through its open end.

10 Claims, 4 Drawing Sheets

CAP COVER FOR KEYBOARD KEYS

BACKGROUND OF THE INVENTION

1. Technical Field

This Application relates to keys for keyboards used in, for example, computers and cash registers. Typically, rows and columns of keys protrude from a base plate. The keys comprise stem-like chimneys on top of which key buttons are provided. The key buttons, or caps, are cone-like umbrellas with a base wider than the top and wider than the top opening of the chimneys. A grid plate with openings arranged in the same pattern as the keys may be fixed to the keyboard frame or the base plate. The grid has openings which are sized so that the keys extend up through the openings in the grid, but the conical key buttons cannot be removed from the top of the chimneys.

2. Background Art

U.S. Pat. No. 2,492,262 to Boyden, et al. discloses a cover for calculating machines. The cover is a flexible plastic cover which fits snugly over the entire keyboard, and even the entire calculating machine.

U.S. Pat. No. 4,948,281 to Werner discloses a keyboard designed to be safe against outside elements, including wet weather. The keyboard has a special grid plate and a draining base plate cover for removing collected liquid from the vicinity of the keyboard keys.

DISCLOSURE OF INVENTION

What I have invented is a cap cover for keyboard keys comprising a generally rectangular in the horizontal plane, hollow box with a closed end and an open end, said open end being adapted to rest on a base plate or a grid plate of a keyboard, and said hollow box being adapted to receive keys or sets of keys through its open end.

The cap cover may be adapted to receive a single key or a plurality of keys. Also, the cap cover may be adapted so the open end rests on a keyboard base frame or on a keyboard grid plate. Optionally, the cap cover is made of a transparent material, and the closed end may have a symbol in it which shows through the surface of it. Also, the closed end may have an arcuate surface on its outside and a flat surface on its inside. The advantage of this particular construction is to magnify the top of the key or keys on which the cap cover is placed, or to magnify the symbol which is in the top surface of the cap cover.

BEST MODE FOR CARRYING OUT INVENTION

Figure 1:
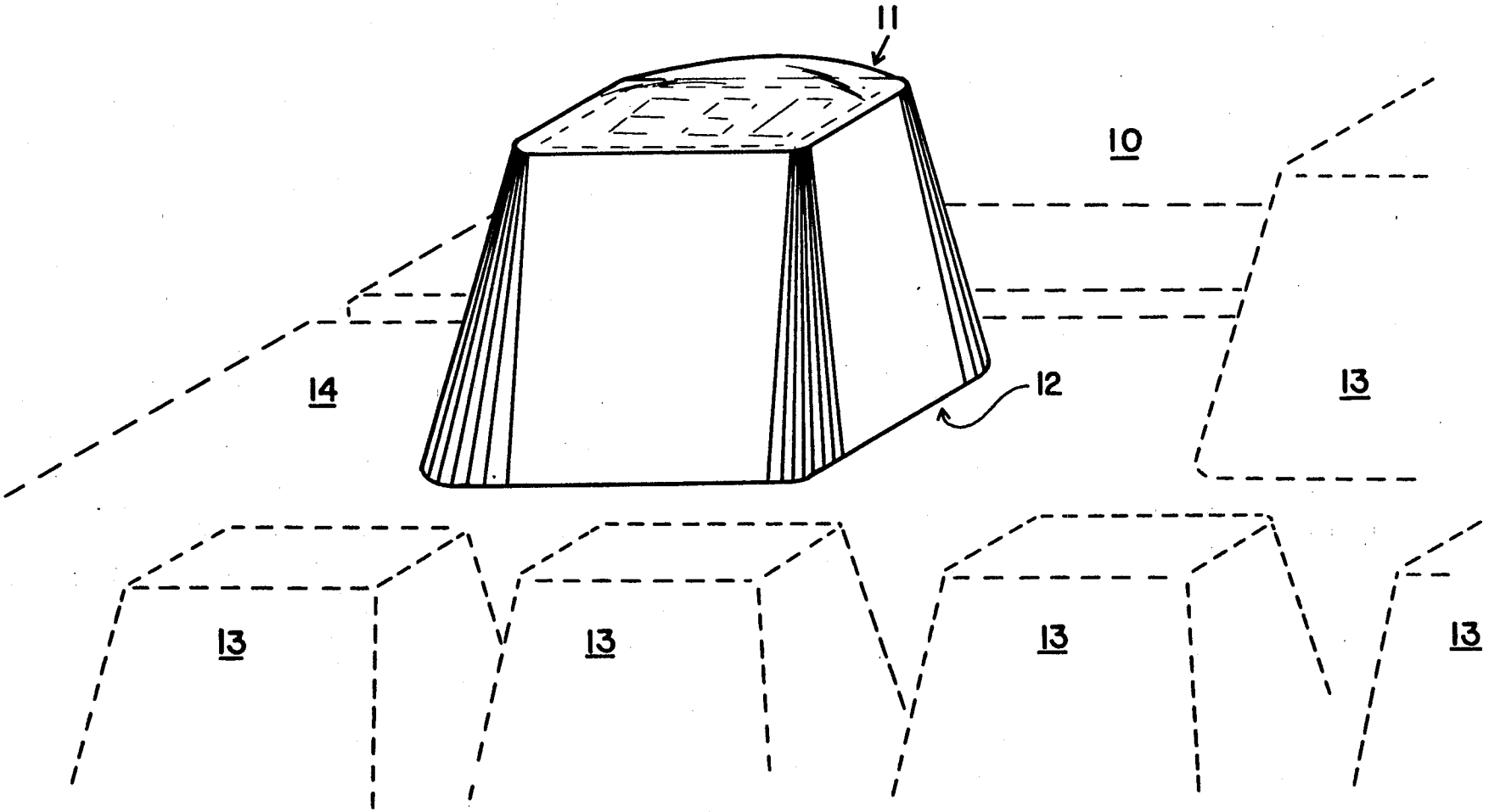
FIG. 1 is a perspective view of my invention's single-key frustro-conical embodiment suspended in space above a single key.

Referring to FIG. 1, there is depicted generally cap cover 10 for a single key with closed end 11 and open end 12. In this Figure, cap cover 10 is a frustro-conical embodiment, with closed small end 11 and open large end 12. In the background are keys 13 of keyboard 14. The closed small end 11 has symbol 15 ("ESC", for example) in it which shows through its surface when the cap cover is made of a transparent material.

Figure 2:
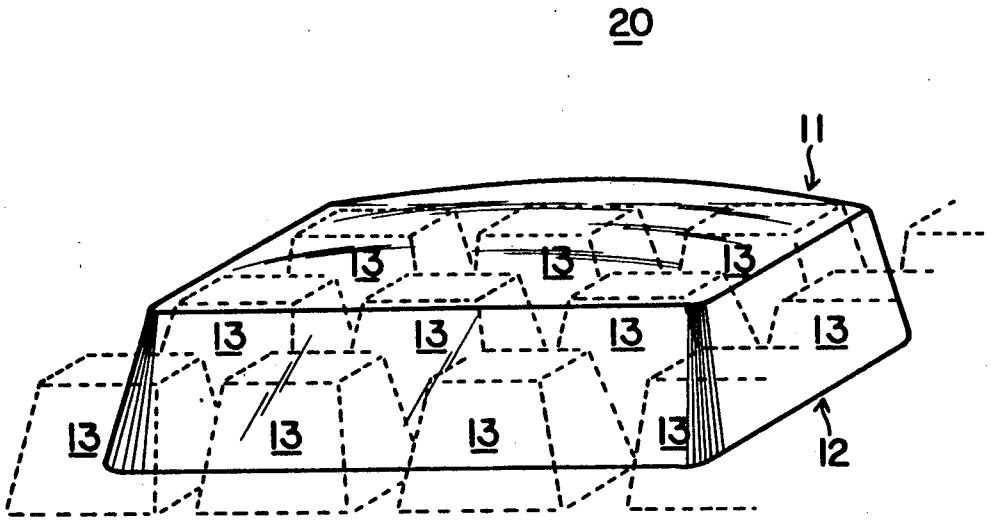
FIG. 2 is a perspective view of my invention's plurality-key frustro-conical embodiment suspended in space above a set of keys.

Referring to FIG. 2, there is depicted generally frustro-conical cap cover 20 for a plurality of keys 13. The cap cover has small closed end 11 and open large end 12.

Figure 3:
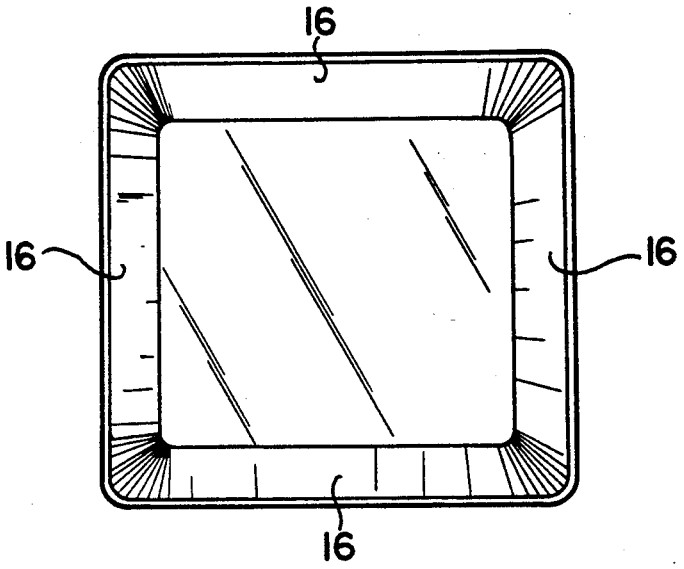
FIG. 3 is a top view of a single-key frustro-conical embodiment of my invention.
Figure 4:
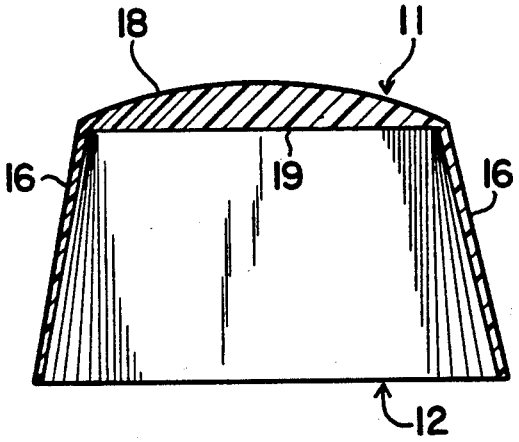
FIG. 4 is a side cross-sectional view of the embodiment in FIG. 3.

Referring to FIG. 3, there is depicted a top view of a frustro-conical single-key embodiment of my invention with sloping side walls 16 joined together to form a generally rectangular perimeter. In FIG. 4, a side cross-sectional view of the embodiment in FIG. 3, there is depicted sloping side walls 16 joined by closed small end 11 to form a frustro-conical box with hollow portion 17 above open large end 12 formed by the terminal edges of sloping side walls 16. Closed small end 11 has arcuate surface 18 on its outside, and flat surface 19 on its inside.

Figure 5:
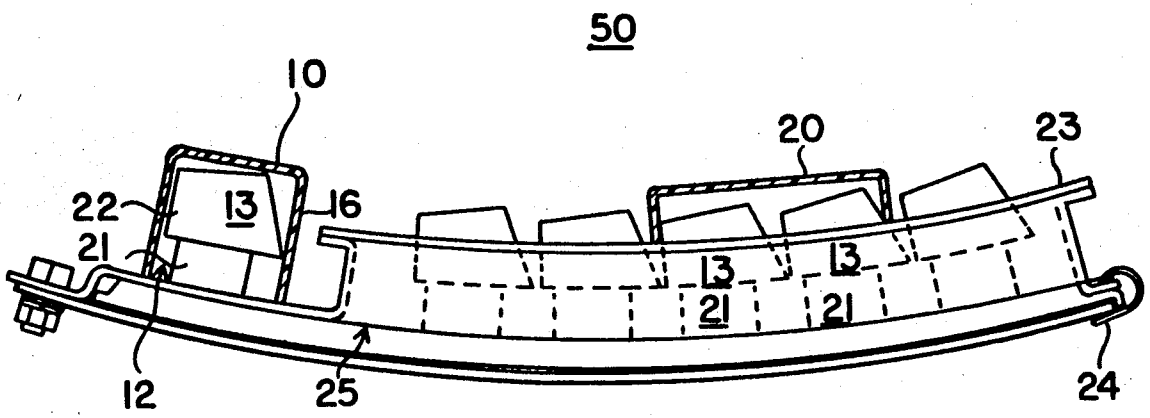
FIG. 5 is a cross-sectional view of two rectangular embodiments of my invention, one for a cap cover which rests on the keyboard base plate, and another for a cap cover which rests on the keyboard grid plate.

Referring to FIG. 5, there is depicted generally in cross-section keyboard 50 with keys 13 protruding from base plate 25. The keys comprise stem-like chimneys 21 on top of which key buttons, or caps, 22 are provided. A grid plate 23 fixed to the keyboard frame 24 is also depicted.

Generally rectangular single-key cap cover 10 is adapted to removably receive key 13 through its open end 12. Open end 12 in this embodiment is adapted to rest on base plate so that only the bottom of keycap cover's 10 side walls contact base plate 25. Generally rectangular, plurality-key cap cover 20 receives keys 13′ and 13″, and rests on grid plate 23.

My cap cover may be generally any shape which does not interfere with the operation of adjoining keys. For example, my cap cover may be generally frustro-conical (larger end on bottom), rectangular or inverse frustro-conical (larger end on top) in the vertical plane. Generally, my cap cover is rectangular in the horizontal plane, though the corners may be rounded for appeal, comfort and safety.

My cap cover may be made from any suitable material, provided the material is rigid enough to protect the key from being depressed when the cover is struck. Preferably, my cover is made from clear on colored plastic for ease and economy of manufacture. Preferably, my cover is made by injection molding.

My cap cover may be made to cover a single key or a plurality of keys. The single key may be a large key, like the "space bar", or a small key, like the "escape" key. The plurality key may be a set of keys, in a single row or column, or a set of keys including keys from multiple rows or columns, or combinations thereof, as required by the user. The specific dimensions of my cap cover may be adapted to fit the particular key or set of keys as required by the user.

Also, side walls 16 from two opposite sides of my cap cover may be removed or adapted to pass over keys, so that my cap cover may be easily moved up and down in a column of keys, or back and forth in a row of keys.

With my invention, a particular key or set of keys may be covered to prevent their inadvertent depression. This feature will protect the user from accidental computing or typing errors which otherwise may result in costly damage to or loss of data, or improper instructions being delivered to the computer.

While there is shown and described the present preferred embodiment of the invention, it is to be distinctly understood that this invention is not limited thereto but may be variously embodied to practice within the scope of the following claims.

I claim:

1. The combination of a keyboard having a plurality of keys, a keyboard base plate and a keycap cover for said keyboard key which consists of a keyboard each of said keys consisting of a stem-like chimney on top of which a keycap is provided, said keyboard keys protruding upwardly from said keyboard base plate; and, a keycap cover which can be selectively positioned on said keyboard base plate and removed from and replaced at a different position on said keyboard base plate, said keycap cover being generally rectangular and consisting of side walls, a closed top end, and an open bottom end, said keycap cover open bottom end being adapted to removably rest on said keyboard base plate at any one of a plurality of different positions; and, said keycap cover open bottom end being adapted to removably receive a keyboard key, said keycap cover contacting only said keyboard base plate and contacting said keyboard base plate only at the bottom of said keycap cover's side walls.

2. The combination of a keyboard having a plurality of keys, a keyboard grid plate and a keycap cover for said keyboard key which consists of a keyboard each of said keys consisting of a stem-like chimney on top of which a keycap is provided, said keyboard keys protruding upwardly from said keyboard base plate, and said keyboard key extending upwardly through an opening in said keyboard grid plate; and, a keycap cover which can be selectively positioned on said keyboard base plate and removed form and replaced at a different position on said keyboard base plate, said keycap cover being generally rectangular and consisting of side walls, a closed top end, and an open bottom end, said keycap cover open bottom end being adapted to removably rest on said keyboard grid plate at any one of a plurality of different positions, and, said keycap cover open bottom end being adapted to removably receive a keyboard key, said keycap cover contacting only said keyboard grid plate and contacting said keyboard base plate only at the bottom of said keycap cover's side walls.

3. The combination of a keyboard key and a cap cover for said key as in claim 1, wherein the keyboard key is a single key.

4. The combination of a keyboard key and a cap cover for said key as in claim 2, wherein the keyboard key is a single key.

5. The combination of a keyboard key and a cap cover for said key as in claim 1, wherein the keyboard key is a plurality of keys.

6. The combination of a keyboard key and a cap cover for said key as in claim 2, wherein the keyboard key is a plurality of keys.

7. The combination of a keyboard key and a cap cover for said key as in claim 1, wherein the closed end of the key cap cover is made of a transparent material.

8. The combination of a keyboard key and a cap cover for said key as in claim 2, wherein the closed end of the key cap cover is made of a transparent material.

9. The combination of a keyboard key and a cap cover for said key as in claim 1, wherein the closed end of said key cap cover comprises an arcuate surface on its outside and a flat surface on its inside.

10. The combination of a keyboard key and a cap cover for said key as in claim 2, wherein the closed end of said key cap cover comprises an arcuate surface on its outside an a flat surface on its inside.

* * * * *